US008858197B2

(12) United States Patent
Kim et al.

(10) Patent No.: US 8,858,197 B2
(45) Date of Patent: Oct. 14, 2014

(54) COMPRESSOR WITH SENSOR AND VALVE PLATE ARRANGEMENT

(75) Inventors: Hak Soo Kim, Daejeon (KR); Ki Beom Kim, Anseong-si (KR); Ik Seo Park, Incheon (KR); Geon Ho Lee, Seongnam-si (KR); Ki Jung An, Seoul (KR); Frank Obrist, Bregenz (AT)

(73) Assignees: Doowon Technical College, Anseing-Shi (KR); Doowon Electronic Co., Ltd, Anseign-Shi (KR)

( * ) Notice: Subject to any disclaimer, the term of this patent is extended or adjusted under 35 U.S.C. 154(b) by 870 days.

(21) Appl. No.: 13/057,404

(22) PCT Filed: Jul. 31, 2009

(86) PCT No.: PCT/KR2009/004318

§ 371 (c)(1),
(2), (4) Date: Feb. 3, 2011

(87) PCT Pub. No.: WO2010/016697

PCT Pub. Date: Feb. 11, 2010

(65) Prior Publication Data

US 2011/0135503 A1 Jun. 9, 2011

(30) Foreign Application Priority Data

Aug. 5, 2008 (KR) ..... 10-2008-0076575

(51) Int. Cl.

| | |
|---|---|
| ***F04C 15/00*** | (2006.01) |
| ***F04B 53/16*** | (2006.01) |
| ***F01C 21/00*** | (2006.01) |
| *F01C 20/24* | (2006.01) |
| *F04C 28/24* | (2006.01) |

(52) U.S. Cl.

CPC ..... *F01C 21/007* (2013.01); *F01C 20/24* (2013.01); *F04C 2240/81* (2013.01); *F04C 2240/30* (2013.01); *F04C 2240/80* (2013.01); *F04C 28/24* (2013.01); *F04C 2230/60* (2013.01)

USPC ..... 417/423.14

(58) Field of Classification Search

USPC ..... 417/279, 423.14, 26, 38, 44.2, 44.4

See application file for complete search history.

(56) References Cited

U.S. PATENT DOCUMENTS 5,483,216 A * 1/1996 Mizutani et al. ..... 337/370

FOREIGN PATENT DOCUMENTS

| | | |
|---|---|---|
| CN | 201133341 Y * | 10/2008 |
| JP | 2006-242003 | 9/2006 |
| JP | 2007-138806 | 6/2007 |
| KR | 1001177368 | 6/1998 |
| KR | 10-0835854 | 6/2008 |

OTHER PUBLICATIONS

English Abstract of CN 201133341 Y dated Oct. 15, 2008.*

* cited by examiner

*Primary Examiner* — Nathan Zollinger
(74) *Attorney, Agent, or Firm* — Ballard Spahr LLP

(57) ABSTRACT

A compressor has a housing with a sensor coupling hole and a control valve coupling hole. A support plate is configured to contact with the compressor housing, the support plate having perforations. A sensor and a control valve pass through the perforations of the support plate respectively at positions corresponding to the sensor coupling hole and the control valve coupling hole. The sensor and control valve are coupled to the sensor coupling hole and the control valve coupling hole respectively. A washer is mounted on an outer peripheral surface of the sensor. The washer passes through the support plate and is inserted into the sensor coupling hole. The washer is coupled to the sensor coupling hole to fix the sensor.

12 Claims, 5 Drawing Sheets

COMPRESSOR WITH SENSOR AND VALVE PLATE ARRANGEMENT

Cross Reference to Related Applications

The present application is a National Phase Application of International Application No. PCT/KR2009/004318, filed Jul. 31, 2009, which claims priority to Korean Patent Application No. 10-2008-0076575, filed Aug. 5, 2008, which applications are incorporated herein fully by this reference.

TECHNICAL FIELD

The present invention relates to a compressor, and more particularly to a compressor in which a sensor and a control valve are mounted to a housing.

BACKGROUND ART

In general, compressors applied to refrigerating air-conditioning systems are classified into reciprocating compressors, rotary compressors, and scroll compressors according to their operation methods.

Here, a reciprocating compressor suctions, compresses, and discharges a working fluid, i.e. a refrigerant while pistons are reciprocating in cylinders and a rotary compressor compresses a refrigerant while a rotor is rotating in a cylinder.

A scroll compressor suctions, compresses, and discharges a refrigerant while a scroll formed between a fixed scroll and a swivel scroll is rotating for one cycle.

Meanwhile, parts for realizing the compression effect are installed within the housing of a compressor, and a pressure sensor, a temperature sensor, a solenoid valve, etc. are mounted to the housing at sides thereof.

The pressure sensor and the temperature sensor are installed at a suction portion and a discharge portion of the compressor to measure properties of a refrigerant flowing through the suction portion and the discharge portion of the compressor.

A control unit receives values measured by the pressure sensor and the temperature sensor and controls the operation of the solenoid valve to suitably set the amount of refrigerant flowing in the compressor.

Hereinafter, a conventional compressor will be described with reference to FIG. 1.

A suction sensor 20, a discharge sensor 30, and a control valve 40 are installed in a housing 10 of the conventional compressor.

Here, since a compression effect of a refrigerant can be expected by securely sealing the interior of the housing 10, the interior of the housing 10 is maintained sealed through welding such that the refrigerant can be prevented from being leaked through portions of the compressor to which the sensors and the control valve are mounted.

However, when a sealing state is maintained by this method, the rate of defective products is high due to additional influences on the sensors and the control valve by welding. Further, the sensors and the control valve cannot be smoothly exchanged and the separated defective sensors and control valve cannot be reused and should be wasted and disposed.

DISCLOSURE

Technical Problem

Therefore, it is an object of the present invention to provide a compressor that allows reduction of the rate of defective parts when such parts as sensors and valves are mounted to its housing and also allows easy exchange of the parts.

Technical Solution

In order to achieve the above-mentioned objects, there is provided a compressor comprising: a compressor housing having a sensor coupling hole and a control valve coupling hole; a support plate configured to contact with the compressor housing and having perforations; a sensor and a control valve passing through the perforations of the support plate respectively at positions corresponding to the sensor coupling hole and the control valve coupling hole, and coupled to the sensor coupling hole and the control valve coupling hole respectively; and a washer mounted on an outer peripheral surface of the sensor passing through the support plate and inserted into the sensor coupling hole, and coupled to the sensor coupling hole to fix the sensor.

Preferably, a recess corresponding to an outer peripheral surface of the control valve inserted into the control valve coupling hole is formed at a portion of the support plate around the control valve coupling hole.

Preferably, the perforation of the support plate through which the sensor passes is partially cutaway.

Preferably, a screw thread screw-coupled to the sensor coupling hole is formed on an outer peripheral surface of the washer and a protrusion protruding outward is formed at a top end of the washer.

Preferably, a stepped portion is formed in the support portion around the perforation through which the sensor passes, a bottom surface of the protrusion of the washer makes surface-contact with a top surface of the stepped portion, and a bottom end of the washer makes surface-contact with a top surface of a catching portion protruding on an outer peripheral surface of the sensor at a lower portion thereof.

Preferably, the stepped portion makes surface-contact with an outer peripheral surface of the protrusion of the washer.

Preferably, a coupling groove into which a driver is inserted is formed at a top surface of the washer.

MODE FOR INVENTION

Hereinafter, an exemplary embodiment of the present invention will be described in detail with reference to the accompanying drawings.

Figure 1:
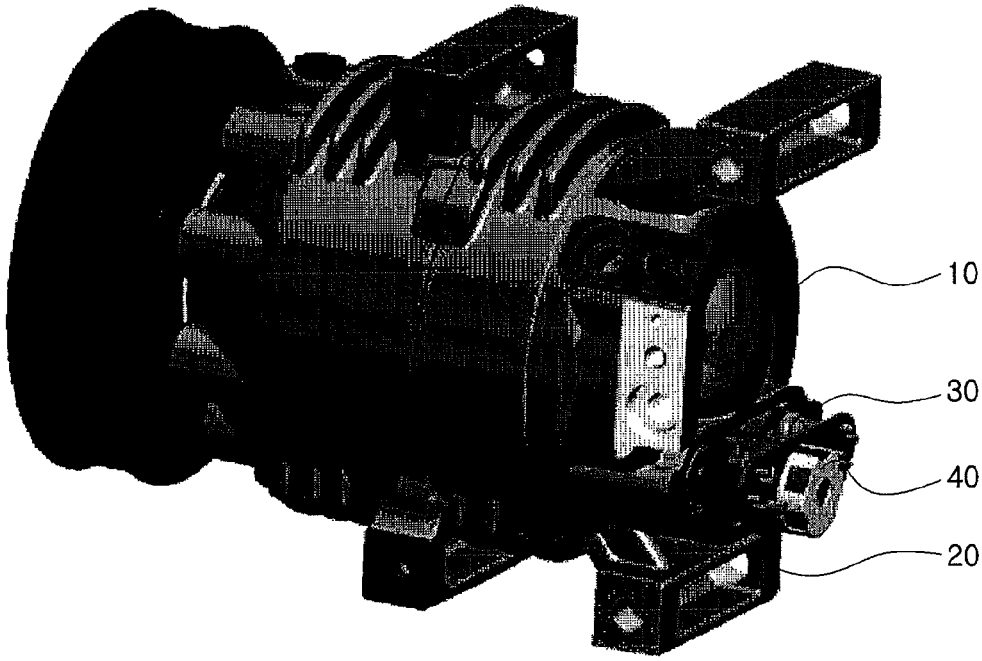
FIG. 1 is a schematic perspective view illustrating a conventional compressor.
Figure 2:
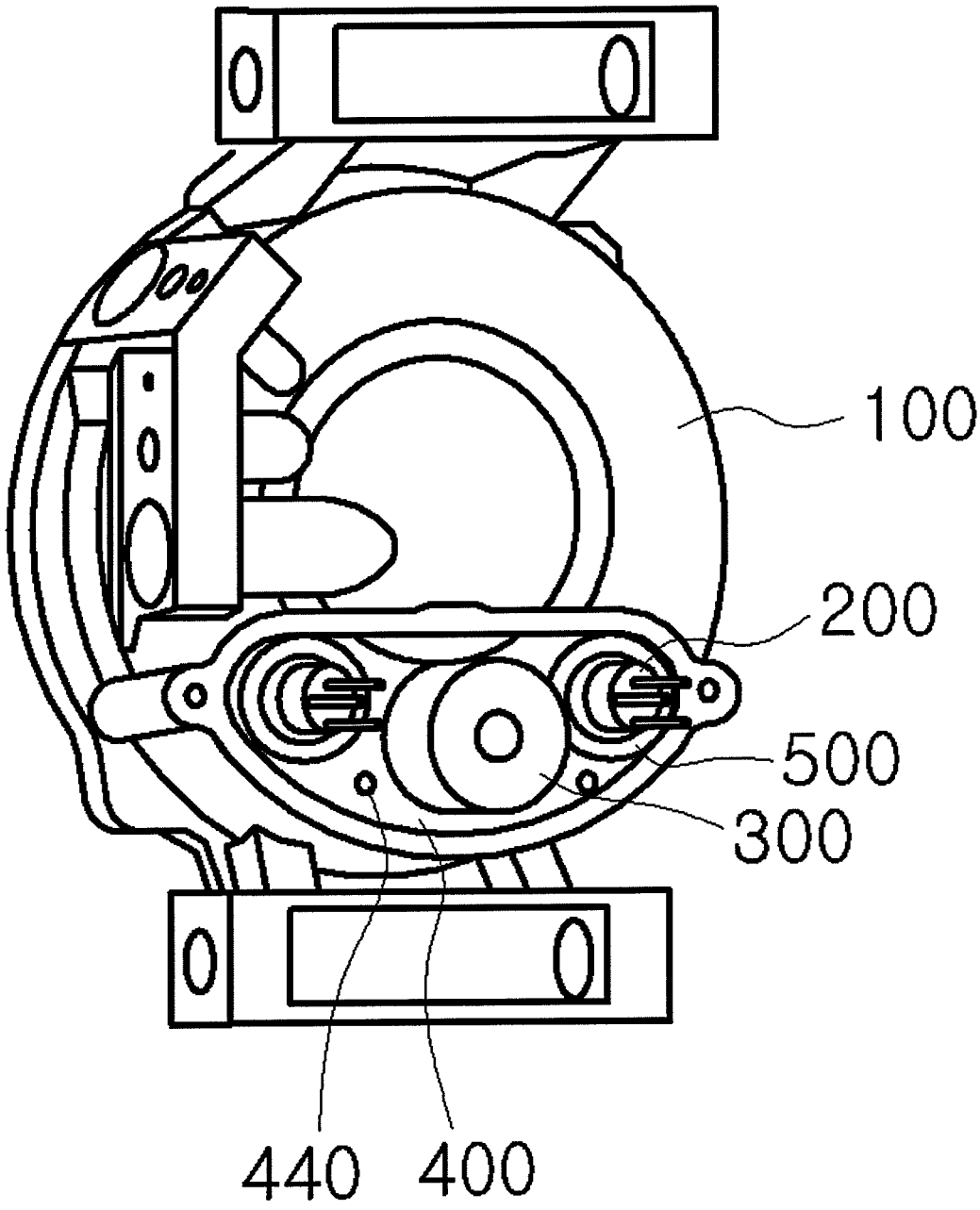
FIG. 2 is a perspective view illustrating a compressor according to an embodiment of the present invention.
Figure 3:
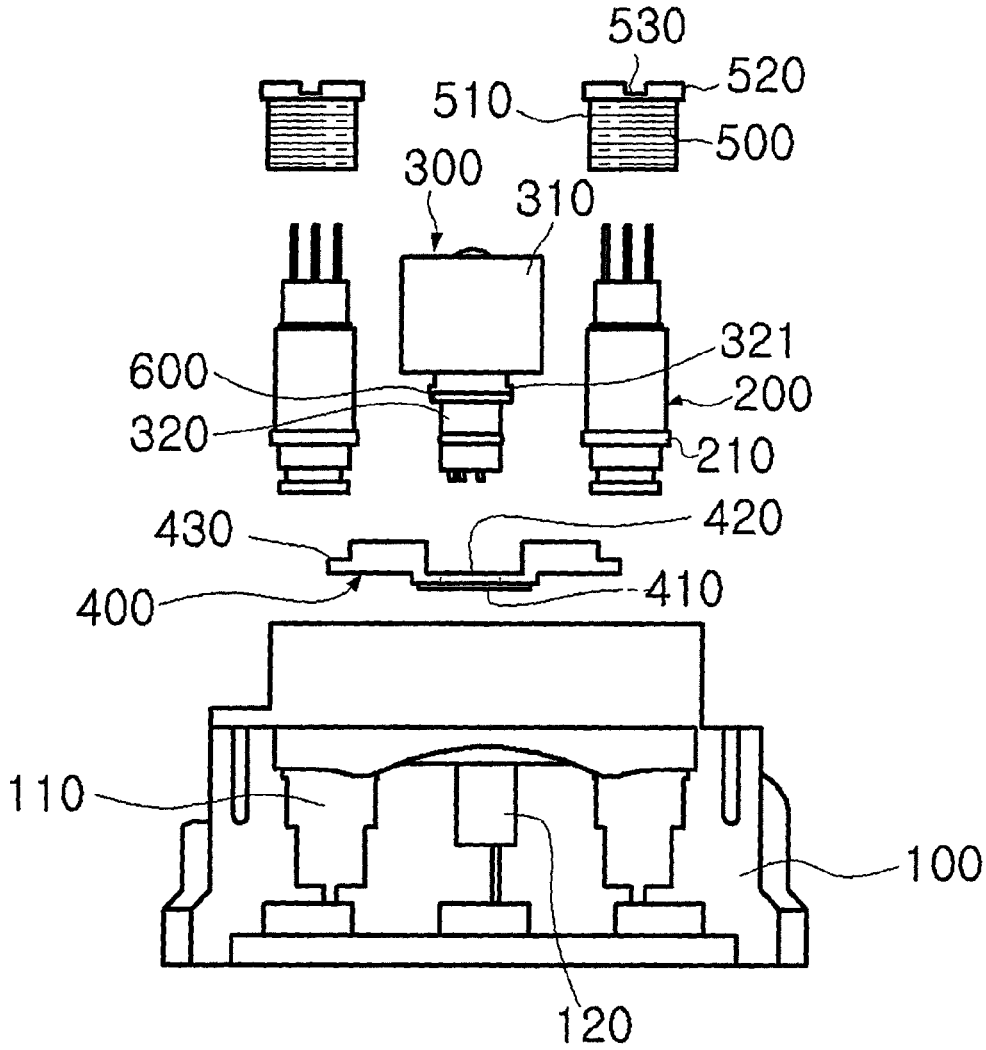
FIG. 3 is an exploded view illustrating a support plate, sensors, a control valve, and a washer of the compressor according to the embodiment of the present invention.
Figure 4:
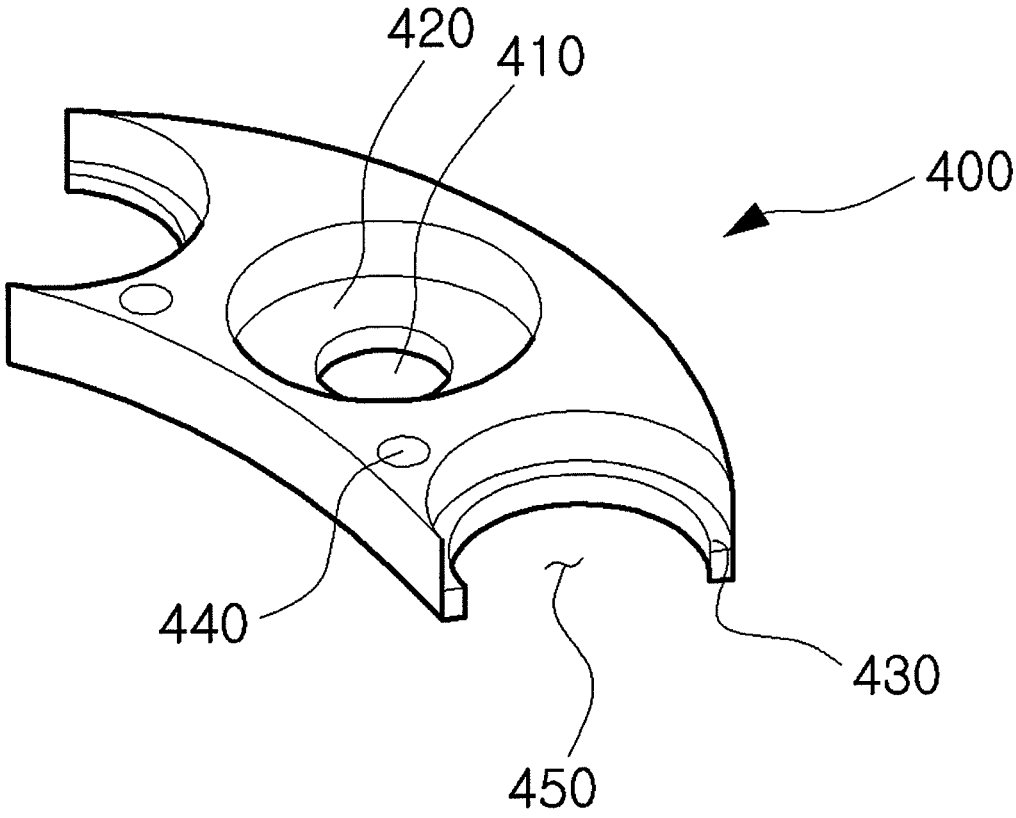
FIG. 4 is a perspective view illustrating a support plate according to the embodiment of the present invention.
Figure 5:
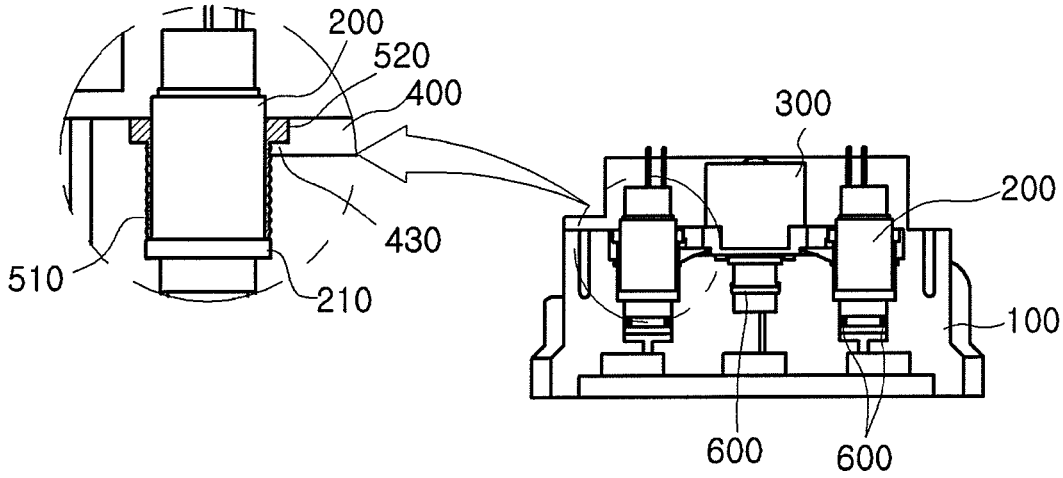
FIG. 5 is a sectional view illustrating a coupled state of the support plate, the sensors, the control valve, and the washer of the compressor according to the embodiment of the present invention.

FIG. 2 is a perspective view illustrating a compressor according to an embodiment of the present invention. FIG. 3 is an exploded view illustrating a support plate, sensors, a control valve, and a washer of the compressor according to the embodiment of the present invention. FIG. 4 is a perspective view illustrating a support plate according to the embodiment of the present invention. FIG. 5 is a sectional view illustrating a coupled state of the support plate, the sensors, the control valve, and the washer of the compressor according to the embodiment of the present invention.

As illustrated in FIG. 2, the compressor according to an embodiment of the present invention includes a compressor housing 100, sensors 200, a control valve 300, a support plate 400, and washers 500.

The sensors 200 are mounted to a suction portion and a discharge portion of the compressor housing 100 to detect the temperature and pressure of a refrigerant flowing through the interior of the compressor.

The control valve 300 is mounted to the compressor housing 100 on a side of one of the sensors 200, and a control unit (not shown) that receives signal values from the sensors 200 controls the control valve 300 to adjust the amount of a refrigerant flowing through the interior of the compressor.

Sensor coupling holes 110 and a control valve coupling hole 120 are formed in the compressor housing 100 such that the sensors 200 and the control valve 300 are mounted thereto.

Meanwhile, catching portions 210 are formed respectively on the outer peripheral surfaces of the sensors 200 and caught by the sensor coupling holes 110 to adjust the insertion lengths of the sensors 200.

The support plate 400 is installed to contact with the compressor housing 100 and has perforations at its positions corresponding to the sensor coupling holes 110 and the control valve coupling hole 120.

Here, the perforations may be in the form of a closed curve or in a partially cutaway form such that the sensors 200 and the control valve 300 can pass through them to be coupled to the sensor coupling holes 110 and the control valve coupling hole 120.

In the embodiment of the present invention, the perforation through which the control valve 300 passes is a closed-curve perforation 410 and the perforations through which the sensors 200 pass are partially cutaway outwardly.

The support plate 400 may have a recess 420 recessed toward the compressor housing 100 at a position corresponding to the control valve coupling hole 120 so that the control valve 300 can be firmly coupled.

In this case, the inner surface of the recess 420 surrounds the control valve 300, preventing the control valve 300 from being shaken laterally.

The perforations 450 through which the sensors 200 pass are formed in the support plate 400 on the right and left sides of the control valve coupling hole 120. As described above, the perforations 450 may be closed-curve perforations or be partially cutaway. In FIG. 4, the perforations 450 are partially cutaway for convenience' sake.

It is preferable that a stepped portion 430 corresponding to the outer peripheral shape of a protrusion 520 formed at an upper end of the below-described washer 500 is formed in the support plate 400 around each perforation 450, and the protrusion 520 of the washer 500 is inserted into and supported by the stepped portion 430.

The support plate 400 has a plurality of screw holes 440 to be coupled to the compressor housing 100 by screws, securing a firm coupling force.

Meanwhile, each washer 500 has a hole in the interior thereof and a screw thread 510 is formed on the outer peripheral surface thereof to be screw-coupled with sensor coupling hole 110. An outward protrusion is formed at an upper end of the washer 500.

Hereinafter, the relations of the compressor housing 100, the sensors 200, the control valve 300, the support plate 400, and the washers 500 will be described with reference to FIGS. 3 to 5.

First, after the coupling hole 410 is aligned with the control valve coupling hole 120 with the recess 420 of the support plate 400 facing the compressor housing 100, the support plate 400 is installed in the housing 100.

Then, the control valve 300 is inserted into the perforation 410 formed in the support plate 400.

In this case, the control valve 300 includes a body portion 310 and a connecting portion 320, and a protrusion 321 is formed in the connecting portion 320.

It is preferable that when the control valve 300 is mounted in the control valve hole 120, the support plate 400 is coupled to a groove between the body portion 310 and the protrusion 321 and an O-ring 600 is mounted to a lower portion of the protrusion 321 to maintain a sealing state.

Thereafter, the sensors 200 are coupled to the sensor coupling holes 110. Here, O-rings 600 for sealing are mounted to the sensors 200.

Then, after the washers 500 are mounted on the outer side of the sensor coupling holes 110, they are screw-coupled to the sensor coupling holes 110 of the compressor housing 100.

The washers 500 may be coupled using a tool such as a driver (not shown), and a groove 530 is formed at a top end of each washer 500 so that a blade of the driver can be inserted thereinto.

Here, the protrusions 520 of the washers 500 pushes the top surfaces of the stepped portions 430 of the support plate 400 to securely couple the support plate 400 to the housing 100.

The top surfaces of the catching portions 210 protruding from the outer peripheral surfaces of the sensors 200 makes surface-contact with the bottom ends of the washers 500 to be coupled and fixed to the sensor coupling holes 110.

Meanwhile, in order to securely fix the support plate 400 to the housing 100, screws may be coupled to the screw holes 440.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

INDUSTRIAL AVAILABILITY

The compressor according to the present invention uses a support plate and washers during an assembling process for installing parts such as sensors and control valves in a compressor housing, without welding them, thereby reducing a rate of defective parts.

Moreover, the sensors and the control valve can be easily exchanged when a disorder occurs in them.

The invention claimed is:

1. A compressor comprising:

a compressor housing having a sensor coupling hole and a control valve coupling hole;

a support plate configured to contact with the compressor housing and having perforations;

a sensor and a control valve passing through the perforations of the support plate respectively at positions corresponding to the sensor coupling hole and the control valve coupling hole, and coupled to the sensor coupling hole and the control valve coupling hole respectively;

a washer mounted on an outer peripheral surface of the sensor passing through the support plate and inserted into the sensor coupling hole, and coupled to the sensor coupling hole to fix the sensor; and wherein a screw thread screw-coupled to the sensor coupling hole is formed on an outer peripheral surface of the washer and a protrusion protruding outward is formed at a top end of the washer.

2. The compressor as claimed in claim 1, wherein a recess corresponding to an outer peripheral surface of the control valve inserted into the control valve coupling hole is formed at a portion of the support plate around the control valve coupling hole.

3. The compressor as claimed in claim 1, wherein the perforation of the support plate through which the sensor passes is partially cutaway.

4. The compressor as claimed in claim 1, wherein a stepped portion is formed in the support portion around the perforation through which the sensor passes, a bottom surface of the protrusion of the washer makes surface-contact with a top surface of the stepped portion, and a bottom end of the washer makes surface-contact with a top surface of a catching portion protruding on an outer peripheral surface of the sensor at a lower portion thereof.

5. The compressor as claimed in claim 4, wherein the stepped portion makes surface-contact with an outer peripheral surface of the protrusion of the washer.

6. The compressor as claimed in claim 1, wherein a coupling groove into which a driver is inserted is formed at a top surface of the washer.

7. The compressor as claimed in claim 2, wherein a stepped portion is formed in the support portion around the perforation through which the sensor passes, a bottom surface of the protrusion of the washer makes surface-contact with a top surface of the stepped portion, and a bottom end of the washer makes surface-contact with a top surface of a catching portion protruding on an outer peripheral surface of the sensor at a lower portion thereof.

8. The compressor as claimed in claim 7, wherein the stepped portion makes surface-contact with an outer peripheral surface of the protrusion of the washer.

9. The compressor as claimed in claim 2, wherein a coupling groove into which a driver is inserted is formed at a top surface of the washer.

10. The compressor as claimed in claim 3, wherein a stepped portion is formed in the support portion around the perforation through which the sensor passes, a bottom surface of the protrusion of the washer makes surface-contact with a top surface of the stepped portion, and a bottom end of the washer makes surface-contact with a top surface of a catching portion protruding on an outer peripheral surface of the sensor at a lower portion thereof.

11. The compressor as claimed in claim 10, wherein the stepped portion makes surface-contact with an outer peripheral surface of the protrusion of the washer.

12. The compressor as claimed in claim 3, wherein a coupling groove into which a driver is inserted is formed at a top surface of the washer.

* * * * *